US008550610B2

(12) United States Patent
Wayman

(10) Patent No.: US 8,550,610 B2
(45) Date of Patent: Oct. 8, 2013

(54) ELECTROCONDUCTIVE TUBING FOR HEATING AND TRANSPORTING LIQUEFIED SOLID INK

(75) Inventor: William H. Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 423 days.

(21) Appl. No.: 12/636,755

(22) Filed: Dec. 13, 2009

(65) Prior Publication Data

US 2011/0141168 A1 Jun. 16, 2011

(51) Int. Cl.
*B41J 2/175* (2006.01)
*B41J 2/195* (2006.01)

(52) U.S. Cl.
USPC ..... 347/88; 347/7

(58) Field of Classification Search
USPC ..... 347/88, 7; 137/334; 424/489; 439/192; 604/113; 428/195; 392/472
See application file for complete search history.

(56) References Cited

U.S. PATENT DOCUMENTS

| | | | | |
|---|---|---|---|---|
| 4,455,474 | A * | 6/1984 | Jameson et al. | 392/472 |
| 4,616,894 | A * | 10/1986 | Baker | 439/192 |
| 5,713,864 | A * | 2/1998 | Verkaart | 604/113 |
| 7,290,872 | B2 * | 11/2007 | Calamita et al. | 347/88 |
| 2002/0012776 | A1 * | 1/2002 | Kaneshiro et al. | 428/195 |
| 2008/0149189 | A1 * | 6/2008 | Jones et al. | 137/334 |
| 2008/0268060 | A1 * | 10/2008 | Nguyen et al. | 424/489 |

* cited by examiner

*Primary Examiner* — Stephen Meier
*Assistant Examiner* — Carlos A Martinez
(74) *Attorney, Agent, or Firm* — Joseph E. Root

(57) ABSTRACT

System and methods for heating and transporting liquefied solid ink in an imaging device. The system includes an electroconductive tube that not only melts the solid ink, but also permits a control system to sense the ink temperature due to the tube's inherent properties. A controller operatively coupled to the electroconductive tube provides power to the tube, which in turn enables current flow. The flow of current resistively heats the electroconductive tube, thereby heating and melting the ink. Further, the controller is configured to control the current flowing through the tube.

19 Claims, 4 Drawing Sheets

ELECTROCONDUCTIVE TUBING FOR HEATING AND TRANSPORTING LIQUEFIED SOLID INK

TECHNICAL FIELD

The presently disclosed embodiments relate to image-forming devices and more particularly, to transportation of ink within an imaging device.

BACKGROUND

Solid ink (also known as phase-change ink) printers conventionally employ ink supplied in solid form, either as pellets or as colored ink sticks. In general, phase change inks are in solid form at ambient temperature, but the ink must be converted to liquid form and transported to the print head, where the ink can be ejected as drops or jets. Generally, this phase change is accomplished by melting the solid ink. At the inkjet head, droplets of molten ink are ejected from a print head, forming jets of ink that print on the target media. When the ink droplets contact the printing media, they quickly solidify to create an image in the desired pattern.

In conventional inkjet imaging devices, feed channels connect the inkjet heads to the image-forming apparatus that may include an ink melting apparatus, transporting the ink from the ink melting apparatus to the inkjet heads. As the solid ink must be melted before transportation, some systems couple a heater assembly with each feed channel to melt and maintain the liquefied solid ink at a predetermined temperature during transportation.

For efficient printer operation, the heater assembly should heat the ink uniformly and quickly, as uneven heating of the ink may result in "hot spots" or "cold spots," which may produce non-uniform images. For example, if the ink is overheated, the color dyes or pigments may be damaged, resulting in image color shifts. If a cold spot exists, the ink may not flow well, possibly leading to shifts in image color due to ink viscosity variation. Further, the image-forming apparatus should monitor the temperature of the feed channel as overheating may melt the feed channels, and under-heating may create cold spots.

Typical ink-heating systems utilize an external heater assembly coupled to feed channel. The heating provided by the external heater depends on the thermal contact with the feed channels; the external heater may not provide consistent ink heating, resulting in cold and hot spots. Moreover, the inaccuracy in thermal coupling between the heater and the feed channel can result in overheating of the heater, and heater failure.

Thus, there remains a need for a device that quickly and uniformly heats/melts or maintains liquefied solid ink at a predetermined temperature during transportation from the image-forming device to the print heads, provides temperature-sensing capabilities, and is cost effective.

SUMMARY

The present disclosure provides a system for heating and transporting liquefied solid ink in an imaging device. The system includes an electroconductive tube operatively coupled to a controller, which is configured to supply power to the electroconductive tube. This power supply enables current flow through the tube, resulting in resistive heating the tube. Subsequently, the solid ink enclosed within is melted. The controller is also configured to control the current flowing through the tube. The system may also include one or more print heads receiving melted ink through the electroconductive tube for imaging.

Another disclosed embodiment provides a method for heating solid ink in an imaging device using an electroconductive tube. The method includes providing current to the electroconductive tube using a controller. The current flow enables resistive heating of the tube. The method includes measuring the current passing through the tube and the voltage drop across the tube. Based on the value of current and voltage, the method includes calculating the resistance of the tube. The resistance of the tube changes with temperature. As the temperature increases, the resistance of the electroconductive tube increases and once the value of the resistance reaches a predetermined value, the controller is turned off for a predetermined time. This time allows the tube to cool slightly.

Another disclosed embodiment provides a system for heating and transporting liquefied solid ink in an imaging device. The system employs a hollow, cylindrical, electroconductive tube including an insulation layer and a metallic layer on the insulation layer. The metallic layer, made of a material exhibiting low resistance and a positive temperature coefficient of resistance, allows current to flow through the tube. The hollow tube encloses solid ink, which is heated once the current starts flowing through the tube. The system also includes a controller, operatively coupled to the tube, configured to supply power to the tube, and measures voltage drop across and current flowing through the tube.

DETAILED DESCRIPTION

The following detailed description is made with reference to the figures. Preferred embodiments are described to illustrate the disclosure, not to limit its scope, which is defined by the claims. Those of ordinary skill in the art will recognize a number of equivalent variations in the description that follows.

Conventional Solutions

Figure 1:
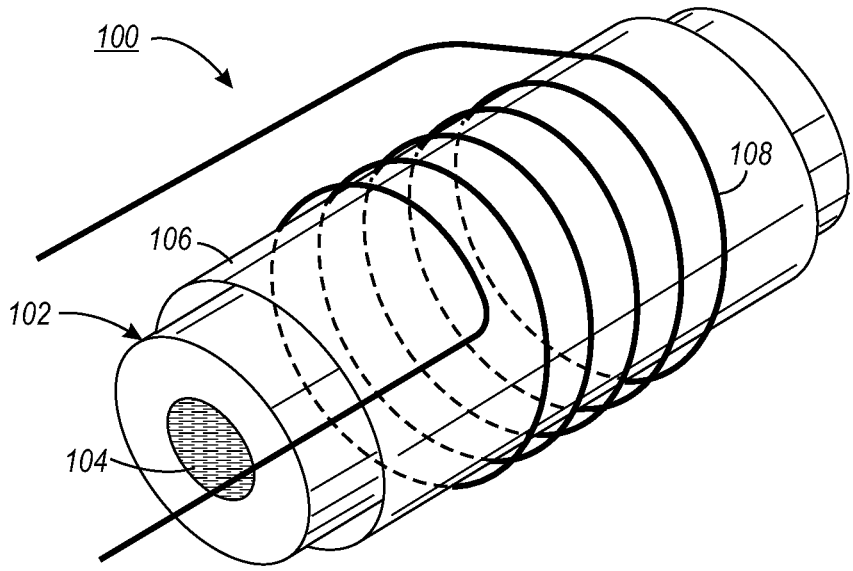
FIG. 1 (Prior Art)
FIG. 1 illustrates a conventional embodiment of an ink transport system.

FIG. 1 illustrates a conventional ink transport system 100 including a feed channel 102 that contains solid ink 104. An electrical insulation layer 106 on the surface of the feed channel 102 provides insulation to the feed channel 102. To melt the solid ink 104, the ink transport system 100 employs an external heater, such as a heater wire 108 wrapped around the feed channel 102. For example, some systems wrap flexible material, such as KAPTON™ insulated filmstrip heaters or heater wires around feed channels. The heater wire 108 heats the feed channel 102, resulting in heating the solid ink 104.

The heating provided by the heater wire 108, however, depends on the thermal contact between the feed channel 102 and the heater wire 108. Typically, the feed channel 102 may not be uniform in shape, or may include bends. Consequently, the heater wire 108 may not be in contact with each portion of the feed channel 102 producing inconsistent heating of the solid ink 104, resulting in cold and hot spots. As different portions of the feed channel 102 may be at different temperatures, the ink transport system 100 does not permit monitoring the temperature of each and every portion of the feed channel 102. Moreover, the process of wrapping the heater wire 108 around the feed channel 102 is labor extensive and expensive.

System Overview

To overcome the known issues of the conventional ink transport system 100, the present disclosure describes a method and system for liquefying and transporting solid ink in an imaging device in connection with various embodiments. The system includes an electroconductive tube that not only melts the solid ink, but also permits a control system to sense the ink temperature due to the tube's inherent properties. A controller operatively coupled to the electroconductive tube provides power to the tube, which in turn enables current flow. The flow of current resistively heats the electroconductive tube, thereby heating and melting the ink. Further, the controller is configured to control the current flowing through the tube.

EXEMPLARY EMBODIMENTS

Figure 2:
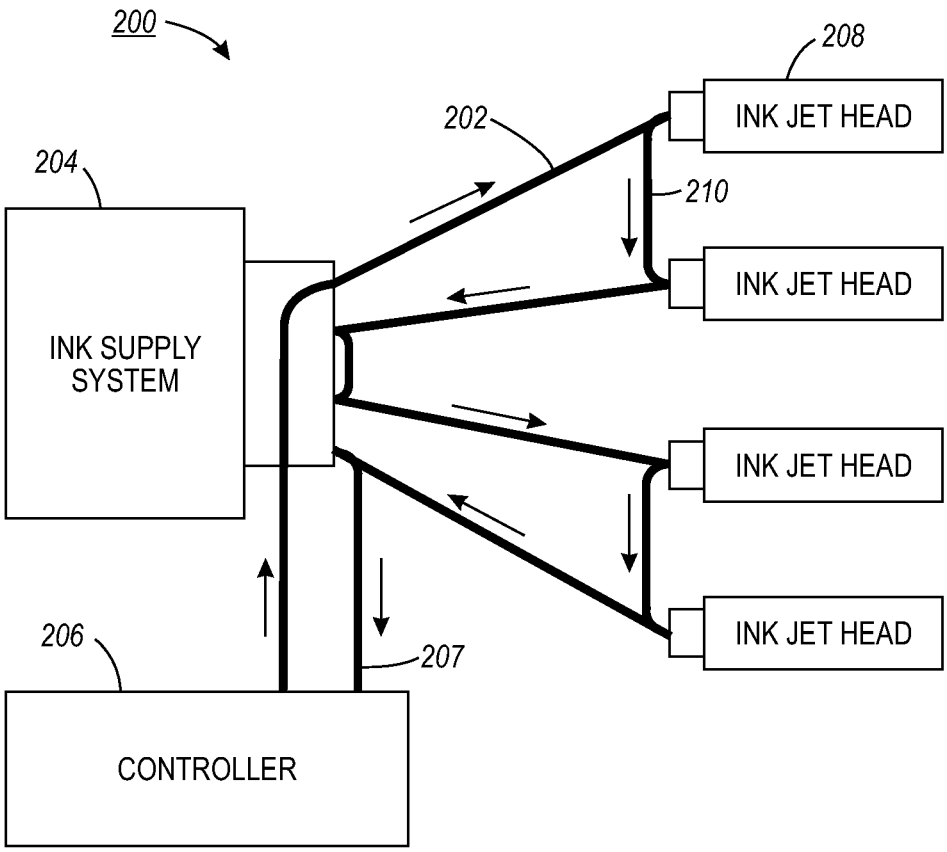
FIG. 2 illustrates an exemplary embodiment of an ink transport system for transporting liquefied solid ink in an imaging device.

FIG. 2 is a schematic diagram of an exemplary ink transport system 200 in an imaging device. The ink transport system 200 may be employed within a device such as a copier, a printer, a facsimile machine, or a finisher, in which solid ink is melted before imaging. Various other embodiments can be anticipated, however, to address many different systems or applications in which solid ink must be melted or maintained at a predetermined temperature.

It should be noted that the description below does not set out specific manufacturing or design details of the various components. Those skilled in the art are familiar with such details, and unless departures from those techniques are set out, techniques, designs, and materials known in the art should be employed. Those in the art are capable of choosing suitable manufacturing and design details.

In the following description, the term "electroconductive tube" refers to a tube that conducts electricity. The terms "electroconductive tube" or "tube" is interchangeably used in the following description. The terms "media" and "sheet" refer to sheets of paper, plastic, cardboard, or other suitable physical substrate for printing images, whether precut or initially web-fed and then cut. Those terms are interchangeable, used throughout the disclosure. Moreover, the term "media paths" and "paths" are also interchangeably as employed below.

The ink transport system 200 includes an electroconductive tube 202 receiving solid ink from an ink supply system 204. A controller 206, operatively coupled to the electroconductive tube 202, by wires 207, supplies power and controls the current flow through the electroconductive tube 202. Typically, an imaging device includes multiple print heads, and liquefied solid ink is supplied to each of these multiple print heads. As illustrated, multiple electroconductive tubes 202 wired in series supply melted ink to a set of inkjet heads 208. Additional wires 210 connect the multiple electroconductive tubes 202 in series and a single controller, such as the controller 206 is coupled to the tubes 202. Alternatively, the tubes 202 may be wired in parallel or each separate tube may be connected to a separate controller.

It should be understood to those skilled in the art that FIG. 2 illustrates only a limited number inkjet heads 208 for simplicity, however, the number of inkjet heads 208 may vary according to the imaging device employed. A typical color printer will employ four ink jet heads 208. The ink jet heads 208 themselves are well known to those skilled in the art and will not be explained in detail here. Moreover, it will be understood by those skilled in the art that other embodiments of the ink jet heads 208 receiving liquefied solid ink for imaging may be employed here.

The electroconductive tube 202 employed in the present disclosure provides two capabilities to the system 200—heating and temperature sensing. The electroconductive nature of the tube 202 enables electric conduction, and electrical current flowing through the tube 202, in turn heats the tube 202, thereby heating the ink. Further, the tube 202 includes a temperature coefficient of resistance; that is, the resistance of the tube 202 varies directly with temperature. Thus, by measuring the resistance of the tube 202, the tube's temperature can be ascertained.

By utilizing the electroconductive tube 202 to heat the ink, the issues introduced by an external heater described in connection with FIG. 1 can be eliminated. To provide heating capabilities, the electroconductive tube 202 is selected from a material exhibiting low resistivity, such as stainless steel or nichrome. For typical materials chosen for this type of application, the resistance of the electroconductive tube 202 can vary from 0.1 to 10 Ohms. One embodiment employs an electroconductive tube 3.18 mm in diameter with a 1 mm wall thickness, formed of stainless steel; that tube exhibits a resistance of 0.17 ohms per meter. As the controller 206 supplies power to the electroconductive tube 202, current starts flowing through the tube 202, which resistively heats the electroconductive tube 202 and the solid ink contained within.

The current flowing through the electroconductive tube 202 continuously increases the tube's temperature, requiring monitoring to cut off the power supply when the tube's temperature reaches a threshold value. Those of skill in the art can set the threshold value based on the melting point of the solid ink, the melting point of the tube material, and similar factors. This monitor conventionally requires an external temperature sensor, increasing overall cost.

The electroconductive tube 202 provides temperature-sensing capabilities to overcome this requirement. To that end, the electroconductive tube 202 is selected from a material that exhibits a positive or negative temperature coefficient of resistance. The resistance of such materials varies directly or inversely with temperature. A positive temperature coefficient material increases in resistance with increasing temperature, while a negative temperature coefficient decreases in resistance with increasing temperature. Working with a positive temperature coefficient material, the system 200 senses the tube's resistance at any point in time, which allows easy calculation of the tube's temperature. The operation of the electroconductive tube 202 as a temperature sensor will be explained in detail in connection with FIG. 4. While the example shown here exhibits a positive temperature coefficient, it will be understood that the system 200 may employ a material having either positive or negative temperature coefficient with resistance for manufacturing the electroconductive tube 202.

To provide both heating and temperature sensing capabilities, the electroconductive tube 202 can be drawn from stainless steel; however, those skilled in the art will understand that any material having a suitable resistivity and a non-zero temperature coefficient of resistance may be selected. Other useful materials are nichrome, and aluminum. In general, handling, manufacturing, and availability factors of stainless steel are favorable, and in addition, its resistivity offers a good match with commercially available low voltage power supplies. Given a typical low cost switching power supply providing 5 volts at 30 or more amps, and electroconductive tube 202 can generate sufficient heat to melt and transport the solid ink.

As noted above, solid inks generally used in the art remain in the solid phase at room temperature. The particular ink chosen in specific applications will generally be selected based on factors such as handling and the like. Most such inks are wax-based, but other materials known to the art can easily be substituted. One characteristic that should be observed is that the conductivity of the chosen ink should not influence the resistance of the electroconductive tube 202.

The controller 206 includes a power supply system for providing power to the electroconductive tube 202, enabling current flow through the electroconductive tube 202. The ink transport system 200 employs a microprocessor-based controller. The controller 206 may employ a low voltage, high current, power supply such as a switching power supply system, which incorporates a switching regulator in order to provide the required output voltage. The controller 206 is also configured to measure current passing through and the voltage drop across the electroconductive tube 202. These functionalities of the controller 206 will be explained in detail in connection with FIG. 4.

Those skilled in the art will be able to select a conventional control mechanism, such as a computer-controlled mechanism, an electromechanical mechanism, or any other suitable mechanism known in the art, for the ink transport system 200. Moreover, various means for operatively connecting the supply system to the electroconductive tube 202 are known in the art.

It will be understood that the embodiment immediately above employs the electroconductive tube 202 in a dual-mode configuration, as both heating element and temperature sensor. The configuration is not required, however, and other embodiments could employ the electroconductive tube 202 in a single-mode configuration, as either a heating element or temperature sensor, but not both. Clearly, the dual-mode configuration offers considerable advantages. In contrast to the feed channel 102 shown in FIG. 1, the electroconductive tube 202 eliminates the external heater, promoting economy. Moreover, the application of the electroconductive tube 202 as a heating element is independent of the structure of the tube 202, providing quick and uniform heating of the solid ink. As a result, the electroconductive tube 202 prevents the known issues of hot spots and cold spots.

Figure 3:
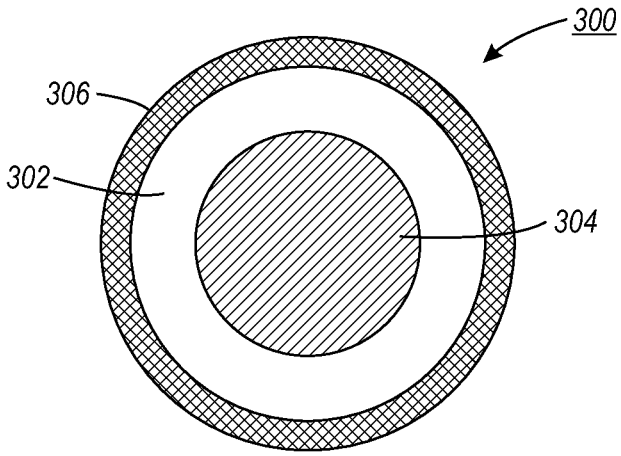
FIG. 3 illustrates an embodiment of an electroconductive tube transporting ink.

FIG. 3 illustrates the structure of an exemplary electroconductive tube 300 transporting liquefied solid ink in an imaging device such as that incorporating the ink transport system 200 described in FIG. 2. Here, the electroconductive tube 300 includes a hollow cylinder 302 containing solid ink 304, and a metallic layer 306 surrounds the surface of the cylinder 302. The hollow cylinder 302 is manufactured from an electrically insulative high temperature plastic such as ULTEM®. The metallic layer 306 on the surface of the cylinder 302 renders capabilities of heating the solid ink 304. Once power is supplied, the metallic layer 306 conducts electricity, resulting in resistive heating of the tube 300. As discussed in FIG. 2, the tube 300 operates as a heater to melt the solid ink 304 and can sense the temperature of the tube 300 by monitoring the resistance of the tube 300.

The metallic layer 306 may be drawn using stainless steel, nichrome, aluminum, or other known material exhibiting low resistance and a non-zero temperature coefficient of resistance. Various other embodiments of the electroconductive tube 300 can be anticipated, however, to address many different systems or applications in which solid ink must be melted or maintained at a predetermined temperature.

Figure 4:
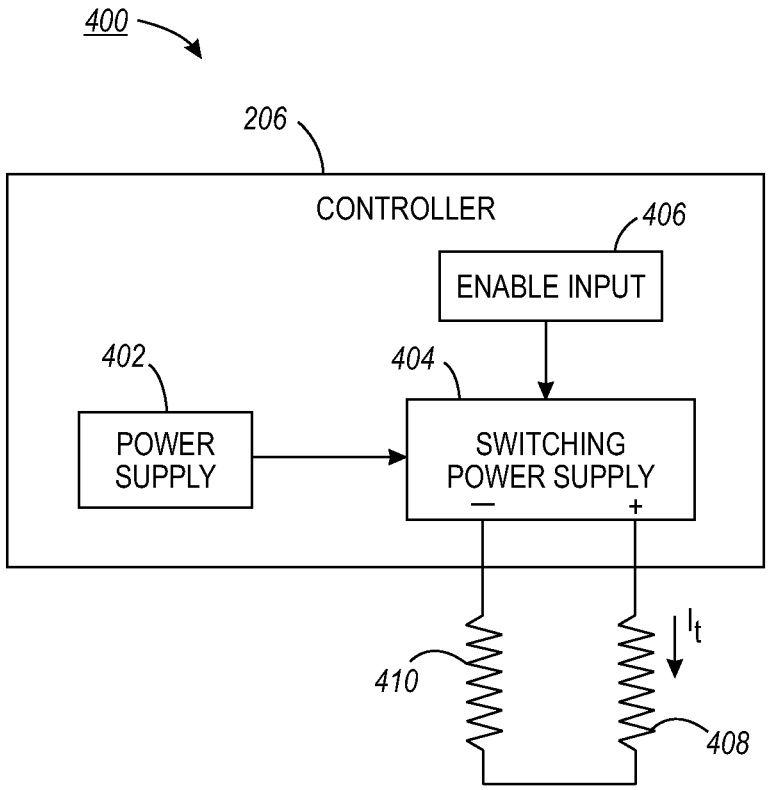
FIG. 4 is a circuit illustrating current flow through the ink transport system of FIG. 2.

FIG. 4 is a circuit 400 illustrating current flow within the electroconductive tube 202 (Shown in FIG. 2), using the controller 206. As discussed in FIG. 2, the controller 206 includes a power source 402 coupled to a switching power supply 404 providing power to the tube 202. An enable input 406 operatively coupled to the power supply 404 allows this power output to flow across to the tube 202.

The power supply 404 provides output power of 5 volts, which is commonly available using any power supply system known in the art. As the resistance of the tube 202 is significantly low, the 5 volt supply generates a large current and power within the electroconductive tube 202, resulting in heating the electroconductive tube 202. For example, with 5 volts applied to 1 meter of stainless steel tubing (with a resistance of 0.17 ohms), a current of about 29 amps will flow in the circuit. This generates electrical power in the order of 145 Watts ($V \times I = 5 \times 29$) in the tube.

When the enable input 406 turns on the power supply 404, the supply applies power to the electroconductive tube 202. This power output enables a current "$I_t$" to flow in the tube 202. A resistor 408 pictorially illustrates the resistance of the electroconductive tube 202. The current "$I_t$" flowing through the resistor 408 results in resistive heating of the electroconductive tube 202. Consequently, the temperature of the solid ink within the electroconductive tube 202 increases, thereby melting the solid ink.

As "$I_t$" flows through the resistor 408, the temperature of the electroconductive tube 202 increases. As already discussed, the temperature increase leads to a corresponding increase in the resistance of the electroconductive tube 202. The controller 206 computes a set point resistance value and compares the resistance of the electroconductive tube 202 with this set point value to monitor the increasing temperature.

To measure the resistance of the electroconductive tube 202, the controller 206 measure the current flowing through the electroconductive tube 202 and the voltage across the electroconductive tube 202. The circuit 400 employs a current shunt 410 to measure the current flowing through the electroconductive tube 202. Those skilled in the art will appreciate that a current shunt includes a small resistance usually employed to measure current. As the current flows in series through the electroconductive tube 202, the shunt 410 may be located in series at any point between the input and output ends of the controller 206. The controller 206 also measures the voltage drop across the electroconductive tube 202. It should be apparent that any small resistance from wiring or electrical connectors would not influence the measurement of voltage drop and hence calculation of tube resistance. The controller 206 uses the value of current and voltage to calculate the resistance of the electroconductive tube 202, as is known in the art.

The controller 206 compares the calculated resistance value with the set point resistance value to identify whether the resistance of the electroconductive tube 202 is greater than the set point value. The set point resistance value is computed based on the resistance at the desired temperature associated with the electroconductive tube 202. The controller 206 uses a number of parameters for calculating this set point resistance value such as the resistance at a known temperature, temperature coefficient, length, diameter, thickness of the tube 202, and other parameters known to those skilled in the art. Alternatively, a one-time temperature-resistance calibration may be performed at the time of manufacture, where the tube's temperature is measured and the resistance is noted and stored as the set point value when the tube 202 reaches the desired temperature. Comparing the tube's resistance value with the set point resistance value ensures that the temperature of the tube 202 is maintained at a certain temperature level. In one embodiment of the circuit 400, the temperature level may correspond to a temperature for transporting liquefied solid ink at about 120 degrees C. In general, the temperature level at which the ink needs to be maintained depends on the components that make up the ink. Further, the temperature range for the liquefied solid ink can be as high as 150-200 degrees Celsius.

If the value of the tube's resistance is greater than the set point resistance value, then the controller 206 disables the enable input 406, resulting in turning off the output of the power supply 404. Consequently, the current flowing through the electroconductive tube 202 stops and the tube 202 starts cooling. Turning off the power supply 404 also disables any calculations of tube resistance by controller 206, as the current and voltage are now both zero. The controller 206 must be programmed to turn off output of the power supply 404 for an appropriate time, enabling sufficient cooling of the electroconductive tube 202. It will be apparent to those skilled in the art that the tube's resistance can only be calculated when the power supply 404 is turned on.

The turn off time for the power supply 404 should not be too long as allowing the tube 202 to cool too much may solidify the ink again. This may result in excessive temperature swings and a long warm up time since the ink must be melted before it can be transported in the tube. Moreover, the turn off time should not be too short, as the controller 206 requires a small amount of time to calculate the tube resistance. If the cool time becomes shorter than the controller's resistance calculation time, the tube 202 will not be under control and will overheat. In one embodiment, the output of the power supply 404 is turned off for 2 seconds allowing the electroconductive tube 202 to cool just enough to allow the resistance of the electroconductive tube 202 to fall under the set point resistance value. Those of skill in the art will recognize the variables, as set out above, and will be able to program the controller 206 appropriately.

In an implementation of the system 200, the electroconductive tube 202 may be covered with insulations not allowing the electroconductive tube 202 to cool quickly. In this case, the turn off time may be increased. To maintain and monitor the temperature of the ink, the power supply 404 is enabled again once the turn off period passes. The controller 206 continually measures the resistance of the tube 202, as long as current is flowing in the tube 202. As a result, the circuit 400 allows heating and maintaining an elevated temperature of liquefied solid ink and monitoring the temperature of the ink using the electroconductive tube 202.

In an embodiment of the circuit 400, an auto zero circuit, not shown in FIG. 4, may also be employed to compensate for small resistance change occurring from connector, external wiring, ageing of components, and other sources known to those skilled in the art. Moreover, the structure of the electroconductive tube 202 may not be uniform from one manufacturing lot to another such as tubing wall thickness or from material property variations from changes in alloy metal content which can result in resistivity variation or coefficient of resistance variation. Certain tube portions have thinner wall structures than others. Thinner walls generally have higher resistance, resulting in a higher resistance set point for controller 206. To eliminate such variances, the circuit 400 is calibrated during fabrication, as well as during any maintenance operation, as desired. To calibrate the circuit 400, the controller 206 measures the resistance of the electroconductive tube 202 at known temperature when first turned on after long cooling period. After long cooling period the controller 206 assumes the tube 202 is cooled to ambient temperature. This ambient resistance value is used to calibrate the circuit 400 after any sufficiently long cooling period.

Figure 5:
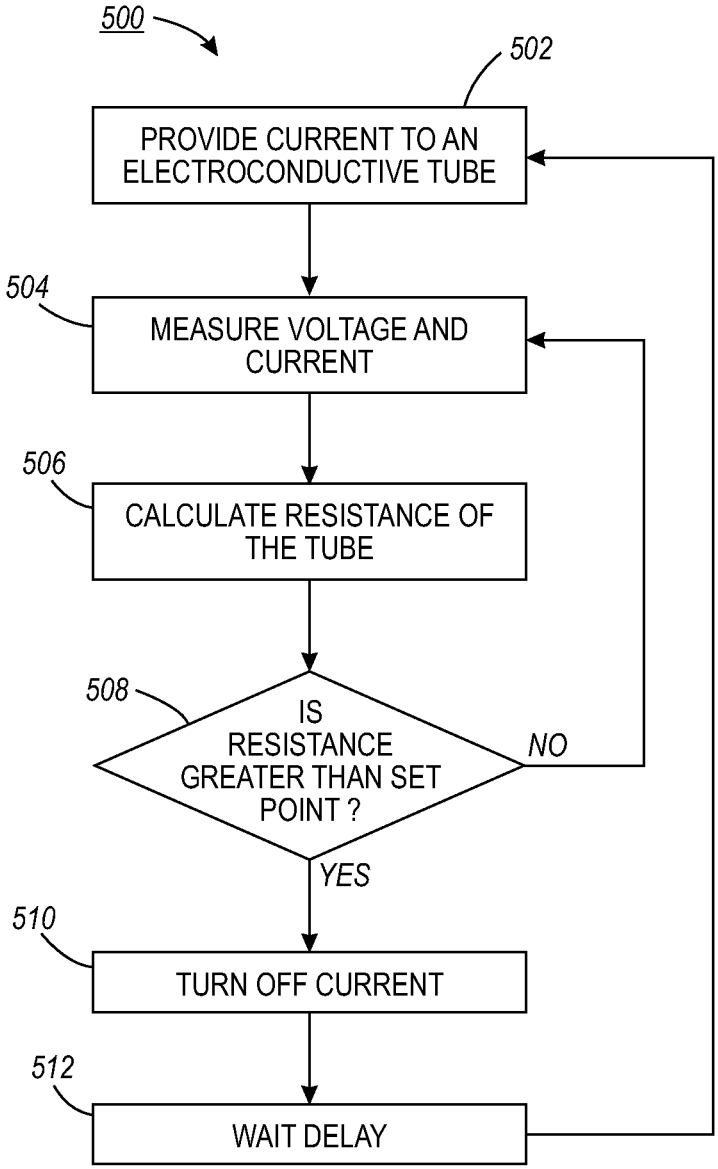
FIG. 5 is a flow diagram illustrating an exemplary method for transporting liquefied solid ink within an imaging device.

FIG. 5 illustrates a flow diagram describing a method 500 for transporting liquefied solid ink within an imaging device. The disclosed method 500 can be associated with any known image-forming device dealing with heating and maintaining liquefied solid ink and monitoring ink temperature, ensuring a compact and cost effective image-forming device.

At step 502, the controller 206 provides current to the electroconductive tube 202. This current flow enables resistive heating of the electroconductive tube 202, resulting in heating and melting the solid ink enclosed within. As discussed in connection with FIGS. 2 and 4, the current flow produces continuous heating of the electroconductive tube 202, thereby increasing its temperature.

To monitor this rising temperature, the method 500 performs steps 504 to 512. At step 504, the method 500 measures the voltage across and the current flowing through the electroconductive tube 202. As illustrated in FIG. 4, the current may be measured using the shunt 410 and the voltage is measured across the ends of the electroconductive tube 202, At step 506, the method 500 calculates the tube's resistance based on the value of the measured current and voltage. As discussed above, the resistance of the electroconductive tube 202 increases with rising temperature; the resistance of the electroconductive tube 202 at any point of time provides an indication of the temperature of the electroconductive tube 202. As described in connection with FIG. 2, the method 500 also includes, as part of the system setup, computing a set point value for the resistance of the electroconductive tube 202, indicating the resistance at the desired temperature.

At step 508, the method 500 compares the resistance of the tube 202 calculated at step 506 with the set point resistance value. If the resistance is less than the set point resistance value, then the method 500 continues to measure the voltage and current to monitor the resistance of the electroconductive tube 202.

If the resistance of the electroconductive tube 202 is greater than the set point resistance value, then at step 510 the controller 206 turns off the power supply provided to the tube 202. This stops the current flowing through the tube 202. Turning off the power supply allows the electroconductive tube 202 to begin to cool down. To permit the electroconductive tube 202 to cool for an appropriate time, the method 500 sets a turn-off delay value. At step 512, the power supply is turned on after the turn off delay time to allow measuring resistance of the electroconductive tube 202. As discussed in connection with FIGS. 2-4, the method 500 provides capabilities of heating solid ink, sensing the temperature of electroconductive tube 202, and controlling the temperature of the electroconductive tube 202.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A system for heating and transporting liquefied solid ink in an imaging device, the system comprising:

an electroconductive tube in fluid communication with a source of liquefied solid ink and with one or more inkjet heads, the tube including a rigid, metallic outer layer, and an insulation layer within the metallic layer, and a controller, including a power supply, electrically coupled to the tube, configured to supply power directly to the tube; and control the current flowing through the tube for regulated heating of the liquefied solid ink.

2. The system of claim 1, wherein the tube has low resistance.

3. The system of claim 1, wherein the resistance of the tube varies with temperature.

4. The system of claim 1, wherein the current flow causes resistive heating of the tube.

5. The system of claim 1, wherein the controller senses the temperature of the ink by measuring the resistance of the tube.

6. The system of claim 1, wherein the controller is further configured to turn off the power supply for a predetermined time once the resistance of the tube reaches a set point.

7. The system of claim 6, wherein the set point is calculated based on one or more of length, diameter, wall thickness, and temperature coefficient of resistance of the tube.

8. The system of claim 1, wherein the ink is poor conductor of electricity.

9. The system of claim 1, wherein the tube provide liquefied solid ink to an inkjet head for imaging.

10. A method for heating and transporting liquefied solid ink in an imaging device, the method comprising:

providing current directly to an electroconductive metallic tube with a rigid metallic outer layer and an inner insulation layer, wherein the current is supplied using a controller and the current flow allows resistive heating of the tube;

measuring the current passing through the tube and the voltage drop across the tube;

calculating resistance of the tube based on the value of the current and the voltage, wherein the resistance of the tube varies with temperature of the tube; and turning off the controller for a predetermined time upon a determination that the value of resistance of the tube reaches a set point value.

11. The method of claim 10, wherein the step of turning off the controller allows cooling of the tube.

12. The method of claim 10, wherein the set point value of the tube is calculated based on one or more of length, diameter, wall thickness, and temperature coefficient of resistance of the tube.

13. A system for heating and transporting liquefied solid ink in an imaging device, the system comprising:

a hollow, cylindrical, electroconductive tube in fluid communication with a source of liquefied solid ink and with one or more inkjet heads, the electroconductive tube including:

an insulation layer;

a rigid, metallic layer on the insulation layer, wherein the metallic layer is made of a material exhibiting low resistance and a non-zero temperature coefficient of resistance, the metallic layer allows current to flow through the tube; and solid ink within the hollow tube, wherein the solid ink is heated once the current starts flowing through the tube; and a controller electrically coupled to the tube, wherein the controller is configured to:

supply power directly to the tube; and measure voltage drop across and current flowing through the tube.

14. The system of claim 13, wherein the current flow causes resistive heating of the tube.

15. The system of claim 13, wherein the controller senses the temperature of the ink by measuring the resistance of the tube.

16. The system of claim 13, wherein the controller is further configured to turn off the power supply for a predetermined time once the resistance of the tube reaches a set point.

17. An imaging device comprising:

an electroconductive metallic tube with a rigid metallic outer layer and an inner insulation layer in fluid communication with a source of liquefied solid ink and one or more inkjet heads receiving the liquefied solid ink from the electroconductive tube; and a controller, electrically coupled to the tube, configured to:

supply power directly to the tube; and control current flowing through the tube for regulated heating of the liquefied solid ink.

18. The imaging device of claim 17, wherein the controller senses the temperature of the ink by measuring the resistance of the tube.

19. The imaging device of claim 17, wherein the controller turns off the power supply for a predetermined time once the resistance of the tube reaches a set point.

* * * * *